US008931465B1

(12) United States Patent
Choma

(10) Patent No.: US 8,931,465 B1
(45) Date of Patent: Jan. 13, 2015

(54) CROSSBOW

(71) Applicant: David Choma, Kent, OH (US)

(72) Inventor: David Choma, Kent, OH (US)

(73) Assignee: Camx Outdoors Inc., Kent, OH (US)

( * ) Notice: Subject to any disclaimer, the term of this patent is extended or adjusted under 35 U.S.C. 154(b) by 22 days.

(21) Appl. No.: 13/775,141

(22) Filed: Feb. 23, 2013

Related U.S. Application Data

(63) Continuation-in-part of application No. 13/300,815, filed on Nov. 21, 2011.

(51) Int. Cl.
*F41B 5/12* (2006.01)

(52) U.S. Cl.
CPC ..... *F41B 5/12* (2013.01)
USPC ..... 124/25; 124/40

(58) Field of Classification Search
USPC ..... 124/25, 40
See application file for complete search history.

(56) References Cited

U.S. PATENT DOCUMENTS

| | | | | |
|---|---|---|---|---|
| 4,716,880 | A * | 1/1988 | Adkins | 124/25 |
| 5,085,200 | A * | 2/1992 | Horton-Corcoran et al. | 124/25 |
| 5,598,829 | A * | 2/1997 | Bednar | 124/25 |
| 6,802,304 | B1 * | 10/2004 | Chang | 124/25 |
| 7,779,824 | B2 * | 8/2010 | Bednar | 124/25 |
| 2009/0078243 | A1 * | 3/2009 | Bednar et al. | 124/31 |

* cited by examiner

*Primary Examiner* — John Ricci
(74) *Attorney, Agent, or Firm* — John D. Gugliotta

(57) ABSTRACT

An improved crossbow is provided having a guard that is integrated into the barrel or stock on each side of the stock which runs parallel to the track or area that the arrow sits in for a length of at least where the string is at rest to where the string is held or secured in the ready or firing position while also having a loaded arrow safety actuator system integrated internally within a crossbow so as to be unexposed to the elements associated with normal outside weather hunting conditions. The loaded arrow safety actuator system incorporates a trigger safety and an arrow retention device for retaining an arrow within a crossbow and alerting a user that the arrow is loaded within the track of a crossbow by allowing the trigger safety to move from a 'safe' position to a 'fire' position.

8 Claims, 15 Drawing Sheets

CROSSBOW

RELATED APPLICATIONS

The present invention is a Continuation-in-Part with copending U.S. Ser. No. 13/300,815 filed on Nov. 21, 2011 and incorporated by reference as if fully rewritten herein.

BACKGROUND OF THE INVENTION

1. Field of the Invention

The present invention relates generally to crossbows and, more particularly, to an improved crossbow having an active finger guard mechanism and a loaded arrow safety actuator system having an arrow retention device.

2. Description of the Related Art

One of the common problems and safety issues with crossbow operation is that, by design and nature, the string of the crossbow moves back and forth in a horizontal plane. This is unlike a conventional bow which moves its string along a vertical plane. As a result of this principle a crossbow is held in almost identical manner to that of a rifle or similar shoulder firearm. In fact, it would be easy to possibly confuse the appearance of the crossbow stock with that of a rifle.

However, unlike with a rifle, in actual operation a typical crossbow requires the use of both hands. The strong or dominate hand is usually placed in the area of the stock that is called the grip and is responsible for not only holding the stock but its primary role is to control the firing control mechanism. The weak or support hand is responsible for supporting, steadying and aiming or aligning the sighting system. This is well know and currently the common principles of most all forms of marksmanship.

These principles of marksmanship facilitate that the support hand be in front of the strong hand and fire control system or trigger. Accepted principles of marksmanship also suggest that the closer the support hand can be to the center of the bore or plane that the projectile travels down the better in that it creates greater accuracy and stability of the weapon can be aimed. When the hand is placed further from the center of the axis then the ability to roll or rotate during sighting is greater.

The well established danger with gripping the stock in its frontal position, also known as the forend, is that on a crossbow the hand and fingers are located under or below the path in which the string travels and back and forth during firing. When the crossbow is cocked or loaded the string of the crossbow is storing a large amount of potential energy. When fired or released, the string moves forward under tremendous force and speed back to its resting or uncocked position.

Because of both its natural firing position and the operation and geometry of the string, it is very easy for most all crossbow users to inadvertently get his fingers or thumb from the support hand in the way of the string path. This can cause great bodily harm and injury. Due to similarities in stock design and marksmanship principles and previous use and or experiences with rifles, this risk to the crossbow user is very great. With rifles this danger does not exist because the support hand is well behind the muzzle or end that the projectile may exit where any potential risk could arise.

It is common, and a well known fact, that parts of the support hand, digits and or thumb are frequently placed and left in the path of the string. In this condition the hand in the path of the string is simply waiting to be impacted and or damaged when the string is allowed to be released forward during the natural and normal firing cycle. As evidence of this widely known and common danger, crossbow manufacturers continue to apply warnings directly to their products and to operation and safety manuals warning of the great potential danger.

Occasionally, manufacturers have tried to haphazardly address the problem by designing stocks or elements within their stocks that attempt to force or locate the support hand well below the string path. While this may offer a solution, or aid in reducing the threat, it is not desired by the end user or does not ensure that the end user will actually place his support hand in the designed area. The forend areas of the stocks have become very massive and heavy and are not comfortable to the end user and reduce the ability to correctly steady and aim the crossbow. Depressions, valleys, grooves and cavities have been incorporated into the stocks as well as raised rails, ribs and or flanges all in an attempt to hold the fingers and thumb out of or below the path of the string.

Today's modern crossbows typically have draw weights in excess of 150 pounds and may be as high as 200 or more pounds of force and can easily be cocked by hand. Drawing the crossbow by hand is quick and does not require the use of time consuming aids and or complicated expensive accessories. One in the art would assume that a solution to keeping the fingers out of the string path would be to place a large flange outward from the stock for some length to block or guard the fingers from entering the string path. The problem with this type of approach is that it widens the track portion of the stock which the arrow sits in and is in the center of the string's path forward. If this area was to be widened over or above the proposed gripping area, which again there is no way to assure that the end user would actually grip the crossbow stock in the intended area, it would interrupt the smooth surface that is used as a guide to ensure the crossbow is cocked on center or symmetrical. As the string is drawn rearward the angle and or pinch placed on the hands and fingers becomes greater the further back. The addition of such a flange which would be wide enough and long enough to allow ample protection of the fingers throughout the string path would cause an excessive, almost unbearable pinch and pressure on the hands/fingers to the point that cocking the crossbow by hand would be impossible.

Another common problem with conventional crossbows involves arrow retention springs. An arrow retention spring is used for retaining an arrow within the track of the barrel prior to activation of the bowstring release mechanism. Conventional arrow retention devices have several problems, one of which includes producing noise upon firing, particularly a 'pinging' sound upon activation of the bowstring release mechanism which discharges the arrow from the crossbow. Any sort of noise when firing a crossbow is undesirable and may scare away potential quarry.

Another problem with conventional arrow retention springs includes user manipulation of the arrow retention spring. Conventional arrow retention springs require user manipulation in order to effectively retain an arrow. Most arrow retention springs are made of a type of steel and must be manually bent in an upward direction in order for an arrow to have enough space to pass under and be retained by the retention spring. Not only does the process of manually manipulating the arrow retention spring waste the user's time and require labor, but the manual manipulation increases the variability in the accuracy of the crossbow due to the variation in tunability of the retention spring which is highly undesirable by hunters.

Yet another common problem and safety issue with crossbow operation occurs when a crossbow is fired without a loaded bolt or arrow which is called a dry fire. Crossbow beginners are at a higher risk of dry firing a crossbow because of their inexperience with using crossbows and beginners may not even be aware that dry firing a bow is dangerous to themselves or their crossbows. Further, a dry fire can occur if a user is distracted while trying to cock or load the bowstring and the bowstring is released before it travels the complete string path to the cocked position, or if a user accidentally fires the cross bow before he loads the arrow or bolt.

Dry firing a crossbow can be dangerous to the user and the crossbow itself. When a crossbow is dry fired, there is a chance that the crossbow limbs, cams, string, axles, and other components can be damaged rendering the crossbow inoperable. Further, because the string is released with such great force, there is a chance that the crossbow components may disengage from the crossbow and injure the user.

A search of the prior art did not disclose any patents that read directly on the claims of the instant invention. Of considerable relevance is U.S. Pat. No. 7,661,418, issued in the name of Bednar et al. While a grip guard member that extends outwardly in a direction that is substantially perpendicular to the is incorporated into this invention in combination, other elements are different enough as to make the combination distinguished over the inventors' own prior art. Also of relevance is U.S. Pat. No. 8,020,543, issued in the name of Maleski et al. While a crossbow dry fire arrestor is disclosed, the dry fire arrestor is incorporated into the trigger sear and trigger mechanism, and the present invention utilizes a dry fire arrestor which is distinguishable over the prior art.

Consequently, a need has been felt for providing an apparatus for and method of operating a crossbow in a safe and effective manner while providing a more effective and efficient loaded arrow safety actuator having an arrow retention device.

SUMMARY OF THE INVENTION

It is therefore an object of the present invention to provide an improved crossbow.

It is a feature of the present invention to provide an improved crossbow having an active finger guard mechanism.

It is another feature of the present invention to provide an improved crossbow having a loaded arrow safety actuator system.

It is yet another feature of the present invention to provide an improved crossbow having a loaded arrow safety actuator system including an arrow retention device that also alerts a user that an arrow is loaded within said crossbow.

It is yet another feature of the present invention to provide an improved crossbow having a loaded arrow safety actuator system including an arrow retention device which produces minimal or negligible vibration upon firing of the crossbow.

It is yet another feature of the present invention to provide an improved crossbow having a loaded arrow safety actuator system including an arrow retention device which is internally housed so as to not be exposed to the elements.

It is yet another feature of the present invention to provide an improved crossbow having a loaded arrow safety actuator system including an arrow retention device which facilitates easier loading of an arrow.

Briefly described according to one embodiment of the present invention, an improved crossbow is provided having a guard that is integrated into the barrel or stock on each side of the stock which runs parallel to the track or area that the arrow sits in for a length of at least where the string is at rest to where the string is held or secured in the ready or firing position while also having a loaded arrow safety actuator system integrated internally within a crossbow so as to be unexposed to the elements associated with normal outside weather hunting conditions. The loaded arrow safety actuator system incorporates a trigger safety and an arrow retention device for retaining an arrow within a crossbow and alerting a user that the arrow is loaded within the track of a crossbow by allowing the trigger safety to move from a 'safe' position to a 'fire' position. The system further incorporates a plunger spring for urging the arrow retention device from a retracted position to a deployed position. Said guard extends outward from the stock in a direction for a length that is perpendicular to the stock or axis/plane of the track or barrel covering the fingers from easily moving up into the path of the string. The invention would ideally extend forward or ahead of the string at rest to so that it could easily be pushed down out of the way prior to cocking or drawing the string rearward. The invention allows the guard or shield on each side to pivot down or out of the way as not to interfere in any way with the cocking or drawing phase of the crossbow be it done by hand or with the assistance of what is known and understood to be a cocking aid.

In accordance with a preferred embodiment, a finger guard is always in a constant up position and held there by a mechanical means which can be pushed down out of the way so as not to interfere with the normal cocking function of the crossbow. It is an improvement to such a configuration that immediately upon completion of the cocking phase and when the hands or cocking aid are removed the guard automatically is raised or redeployed to its protective position without any user aid or assistance.

Further, the guard may be positioned or the shield may be designed or of a shape that stops on or minimally rests against the lower portion of the string to ensure its upper most position runs the entire length of the power stroke so as not to snag or grab the string.

Further still, the guard or shields are mechanically attached in a manner that keeps them secure to the crossbow stock assembly and that removal of said safety device requires user interaction and removal.

Finally, the shields as defined by the present invention may be made from any of known and accepted materials and manufacturing processes, may be decorated or colored to call attention or warning, and may also contain text or labels to give further warning and or instruction.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
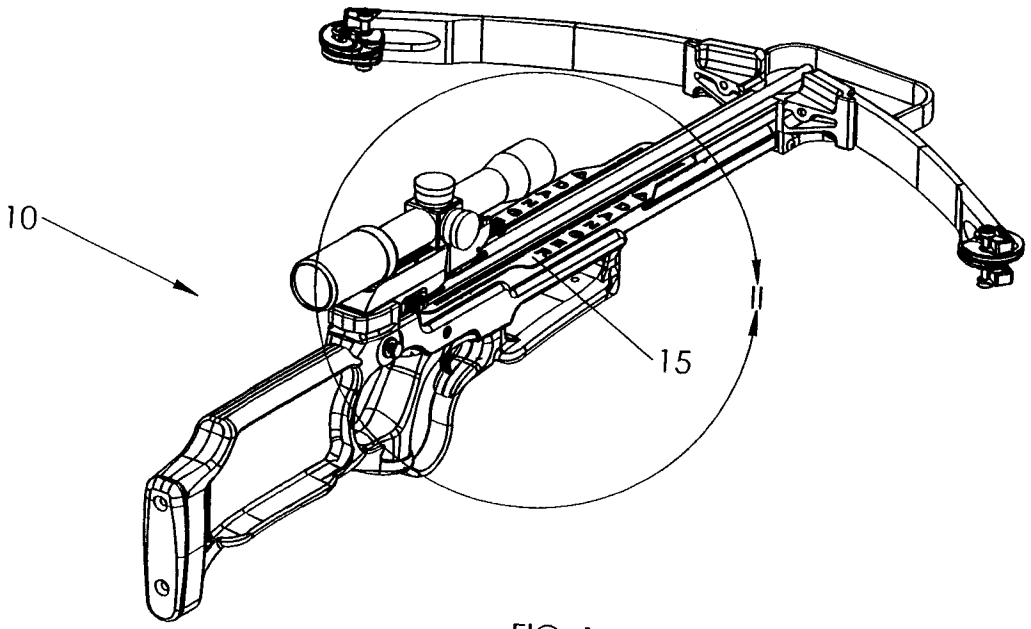
FIG. 1 is a perspective view of an improved crossbow according to the preferred embodiment of the present invention having an active finger guard mechanism 15 shown in a deployed condition.

The best mode for carrying out the invention is presented in terms of its preferred embodiment, herein depicted within the Figures.

1. Detailed Description of the Figures

Referring to FIG. 1 through FIG. 8, an improved crossbow, generally noted as 10, is provided having a guard system 15 that is integrated into the barrel or stock 20 on each side of the stock which runs parallel to the track 25 or area that the arrow sits in for a length of at least where the string (not shown) is at rest to where the string is held or secured in the ready or firing position. The guard system 15 incorporates a pair of shields 30, each pivotally affixed along the stock, and extend outward from the stock 30 in a direction for a length that is perpendicular to the stock 30 or axis/plane of the track 25 covering the fingers from easily moving up into the path of the string. In a preferred embodiment each shield 30 would extend forward or ahead of the string at rest to so that it could easily be pushed down out of the way prior to cocking or drawing the string rearward.

Each shield 30 is affixed such as to pivot down or out of the way as not to interfere in any way with the cocking or drawing phase of the crossbow, be it done by hand or with the assistance of what is known and understood to be a cocking aid.

Figure 2:
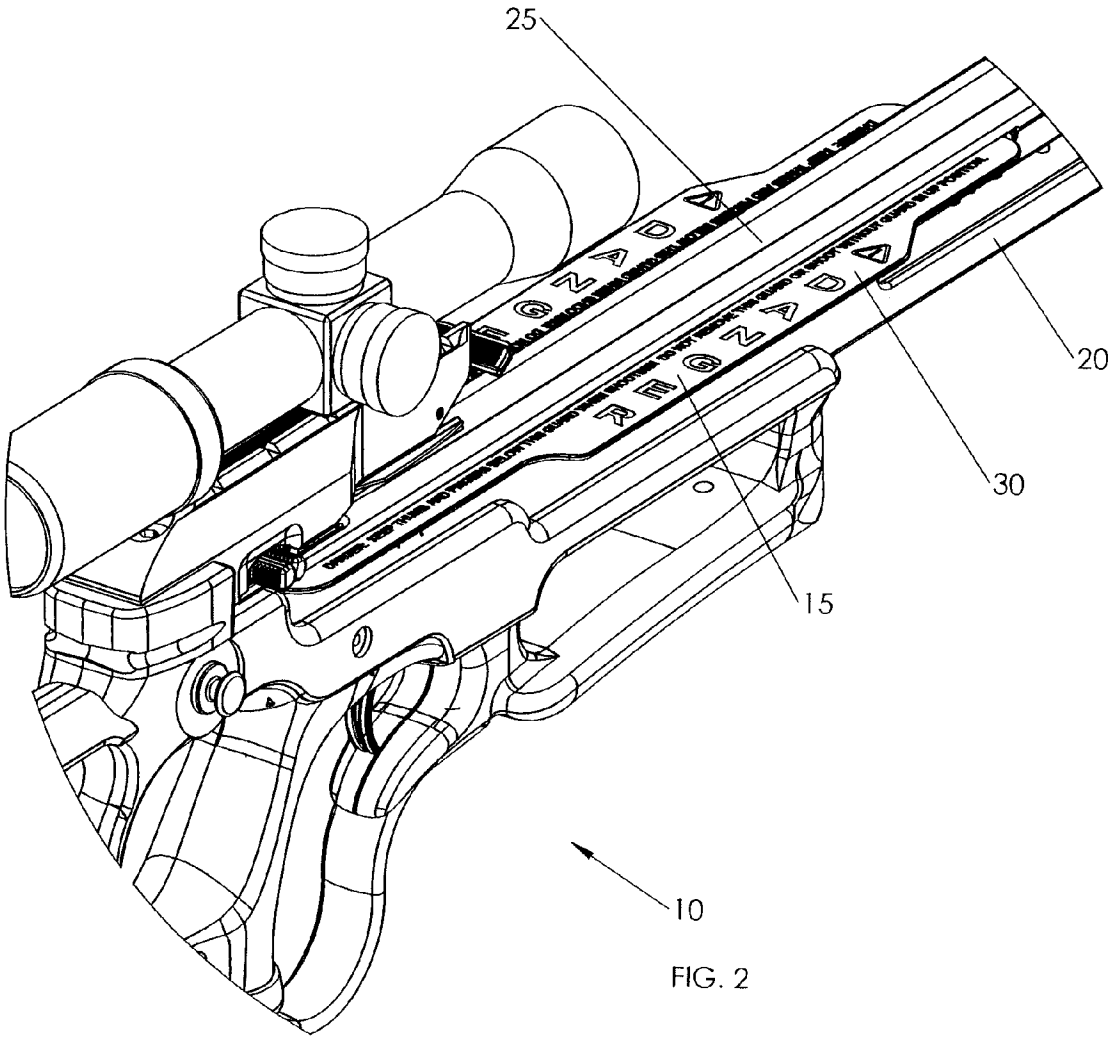
FIG. 2 is a partial, enlarged detail view thereof taken along detail A of FIG. 1.
Figure 3:
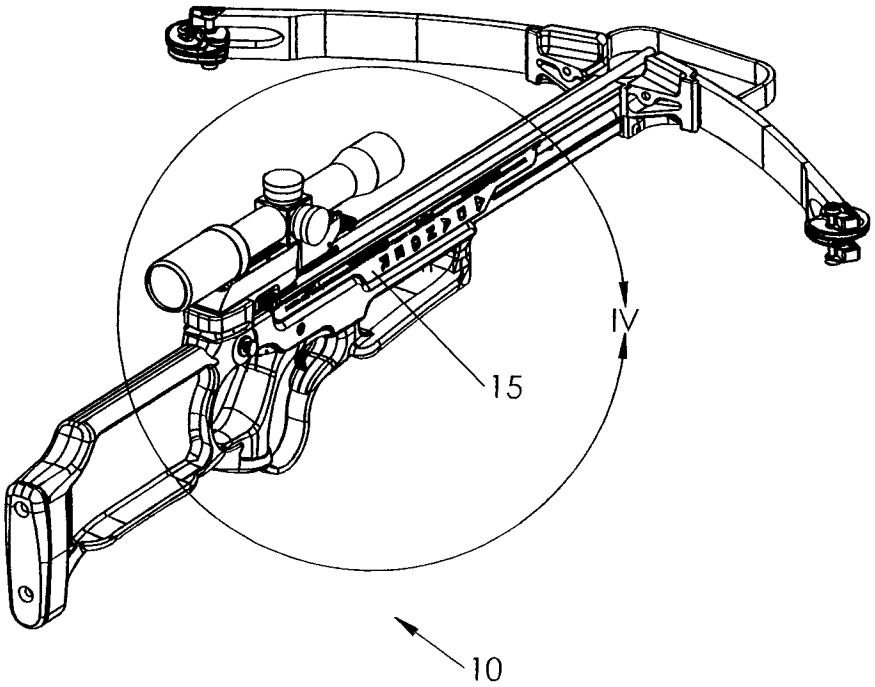
FIG. 3 is a perspective view of an improved crossbow according to the preferred embodiment of the present invention having an active finger guard mechanism 15 shown in a retracted condition.
Figure 4:
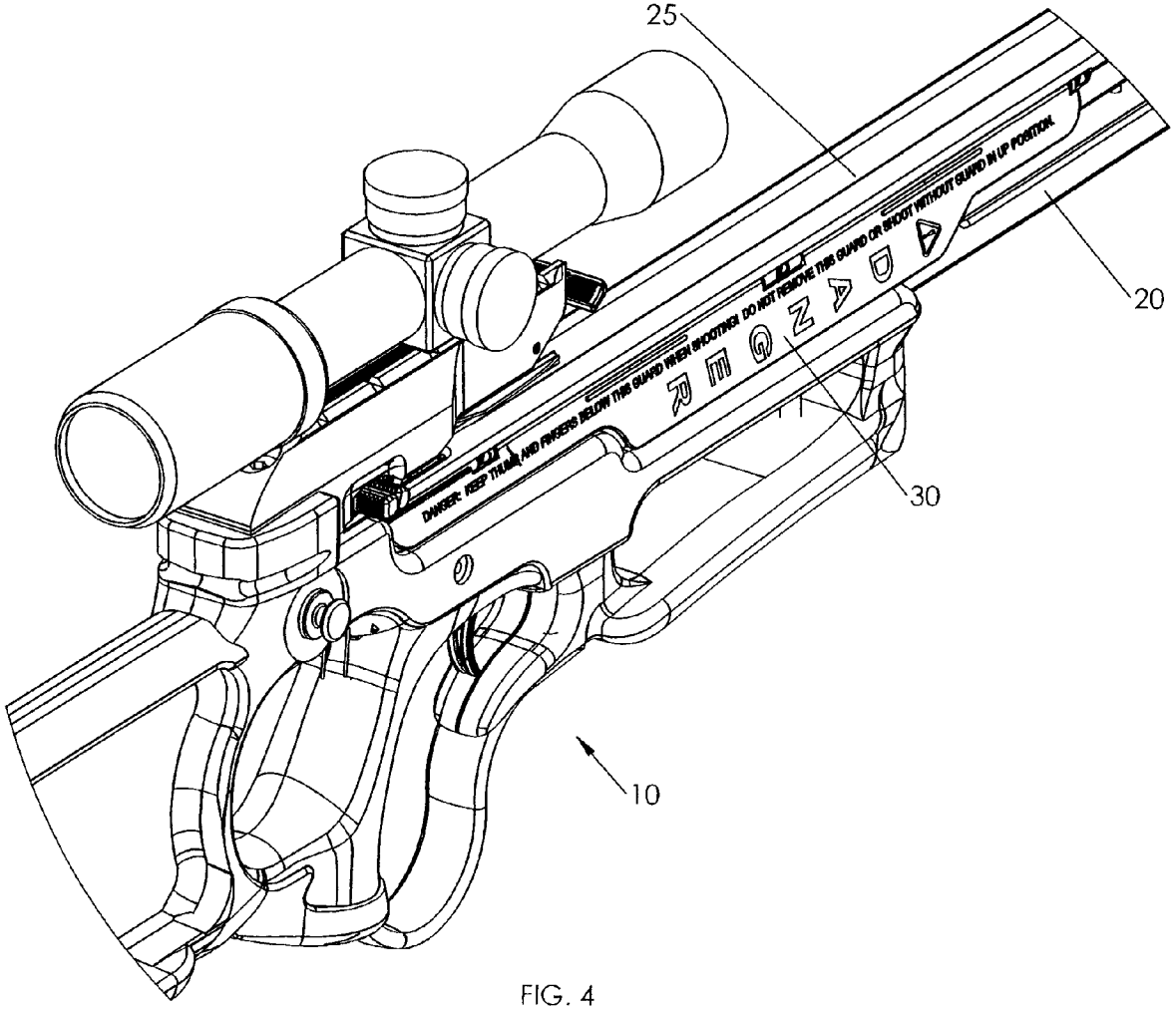
FIG. 4 is a partial, enlarged detail view thereof taken along detail B of FIG. 3.
Figure 6:
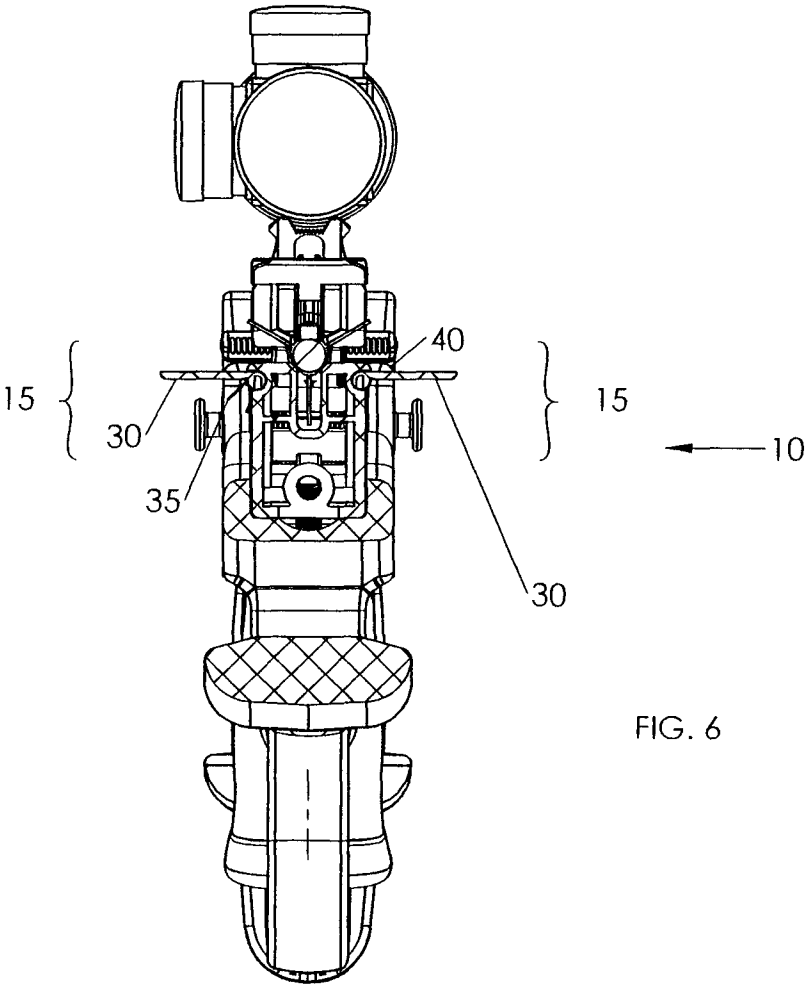
FIG. 6 is a partial, enlarged detail view thereof taken along section VI-VI of FIG. 8.
Figure 5:
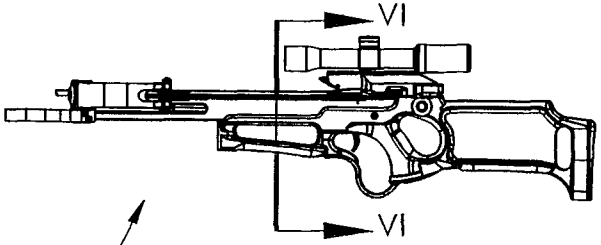
FIG. 5 is a side elevational view of an improved crossbow according to the preferred embodiment of the present invention having an active finger guard mechanism 15 shown in a deployed condition.
Figure 8:
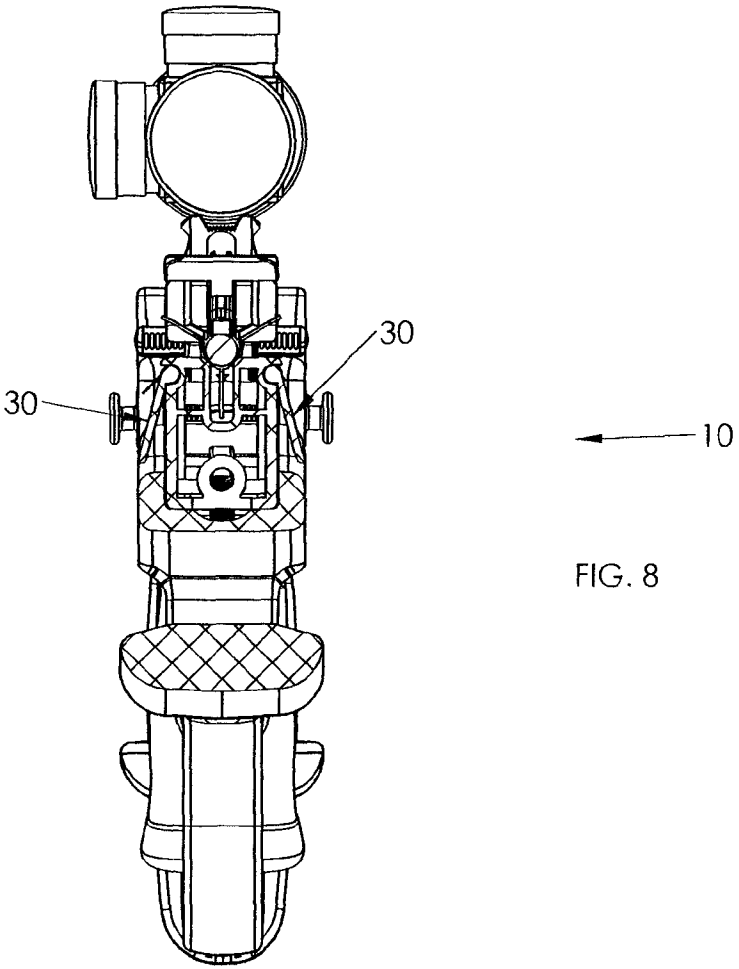
FIG. 8 is a partial, enlarged detail view thereof taken along detail VIII-VIII of FIG. 7.
Figure 7:
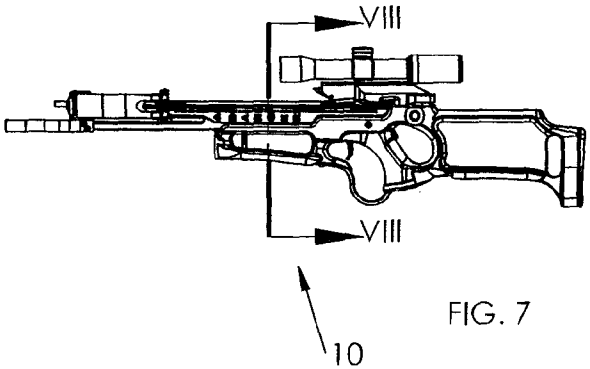
FIG. 7 is a side elevational view of an improved crossbow according to the preferred embodiment of the present invention having an active finger guard mechanism 15 shown in a retracted condition.
Figure 9:
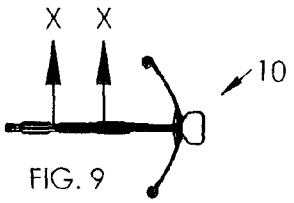
FIG. 9 is a top elevational view of an improved crossbow according to one embodiment of the present invention having a loaded arrow safety actuator system with the trigger safety in a 'safe' position.
Figure 10:
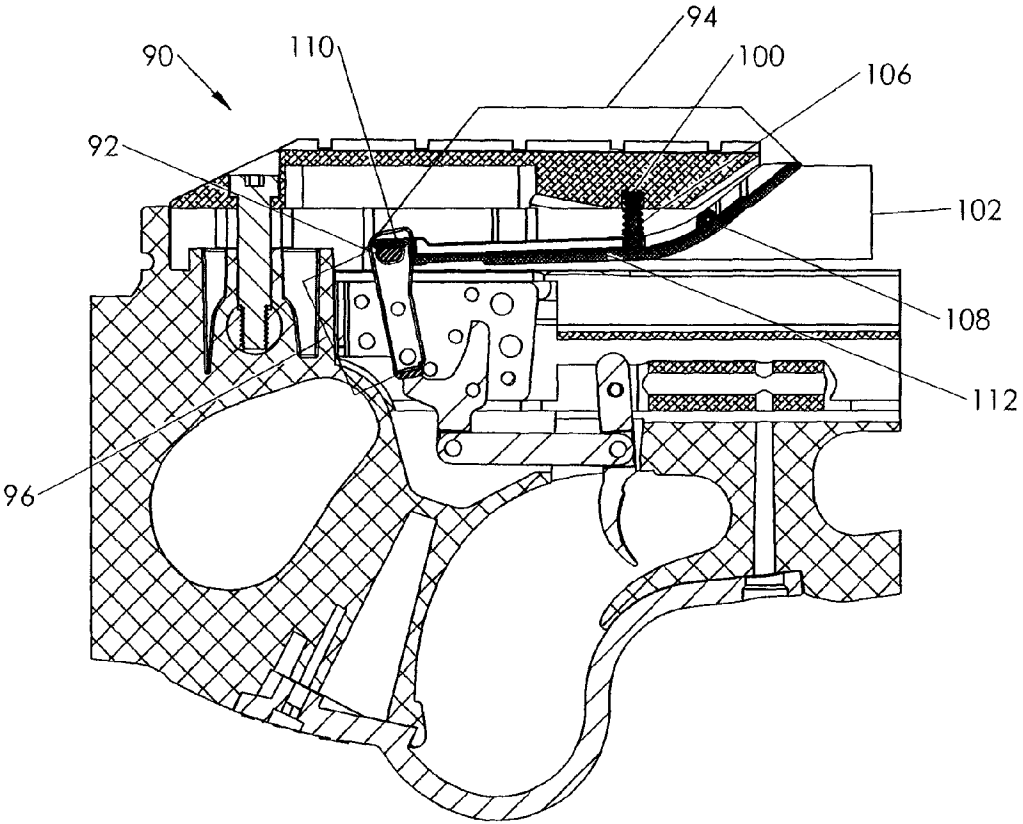
FIG. 10 is a partial, enlarged detail view thereof taken along detail X-X of FIG. 9.
Figure 11:
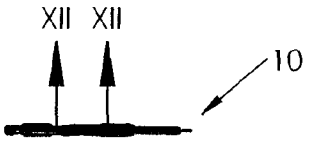
FIG. 11 is a top view of an improved crossbow according to one embodiment of the present invention having a loaded arrow safety actuator system with the trigger safety in a 'fire' position.
Figure 12:
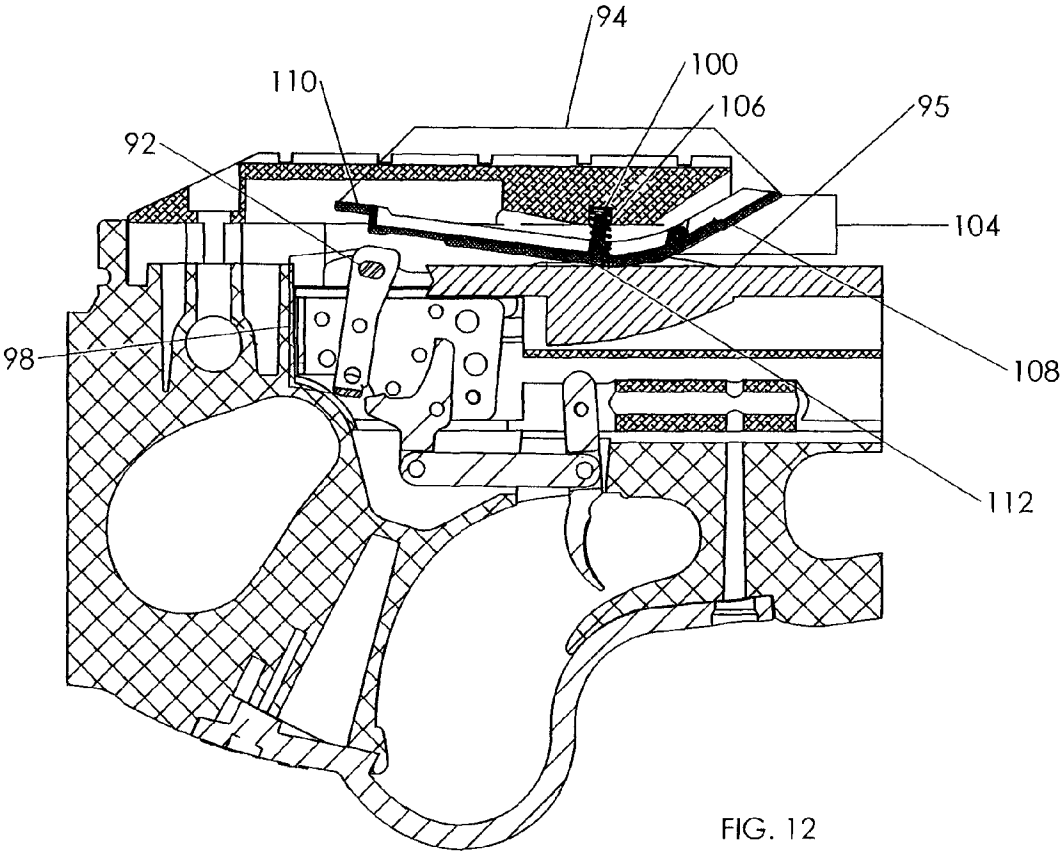
FIG. 12 is a partial, enlarged detail view thereof taken along XI-XI of FIG. 11.
Figure 14:
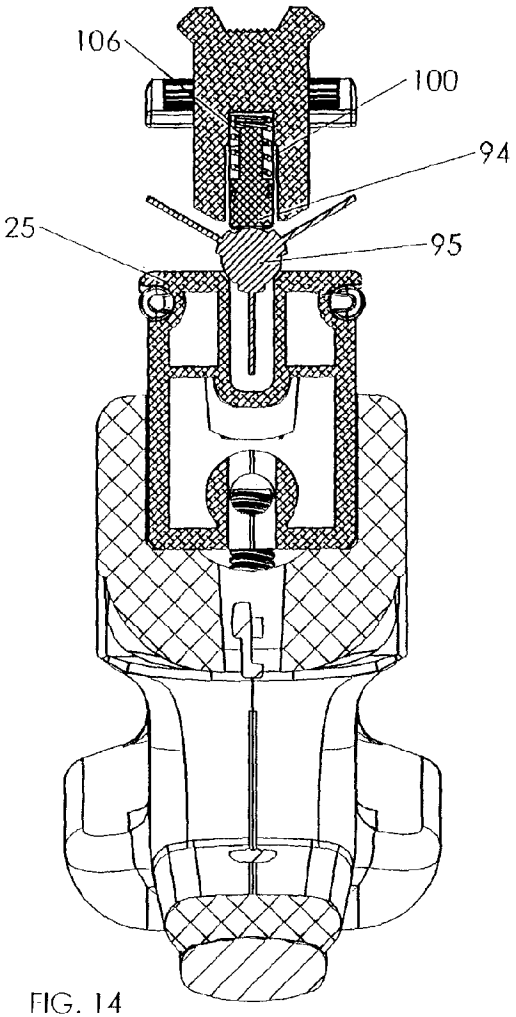
FIG. 14 is a partial, enlarged detail view thereof taken along XIII-XIII of FIG. 13.
Figure 13:
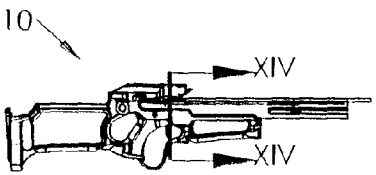
FIG. 13 is a side elevational view of an improved crossbow according to one embodiment of the present invention having a loaded arrow safety actuator system.
Figure 16:
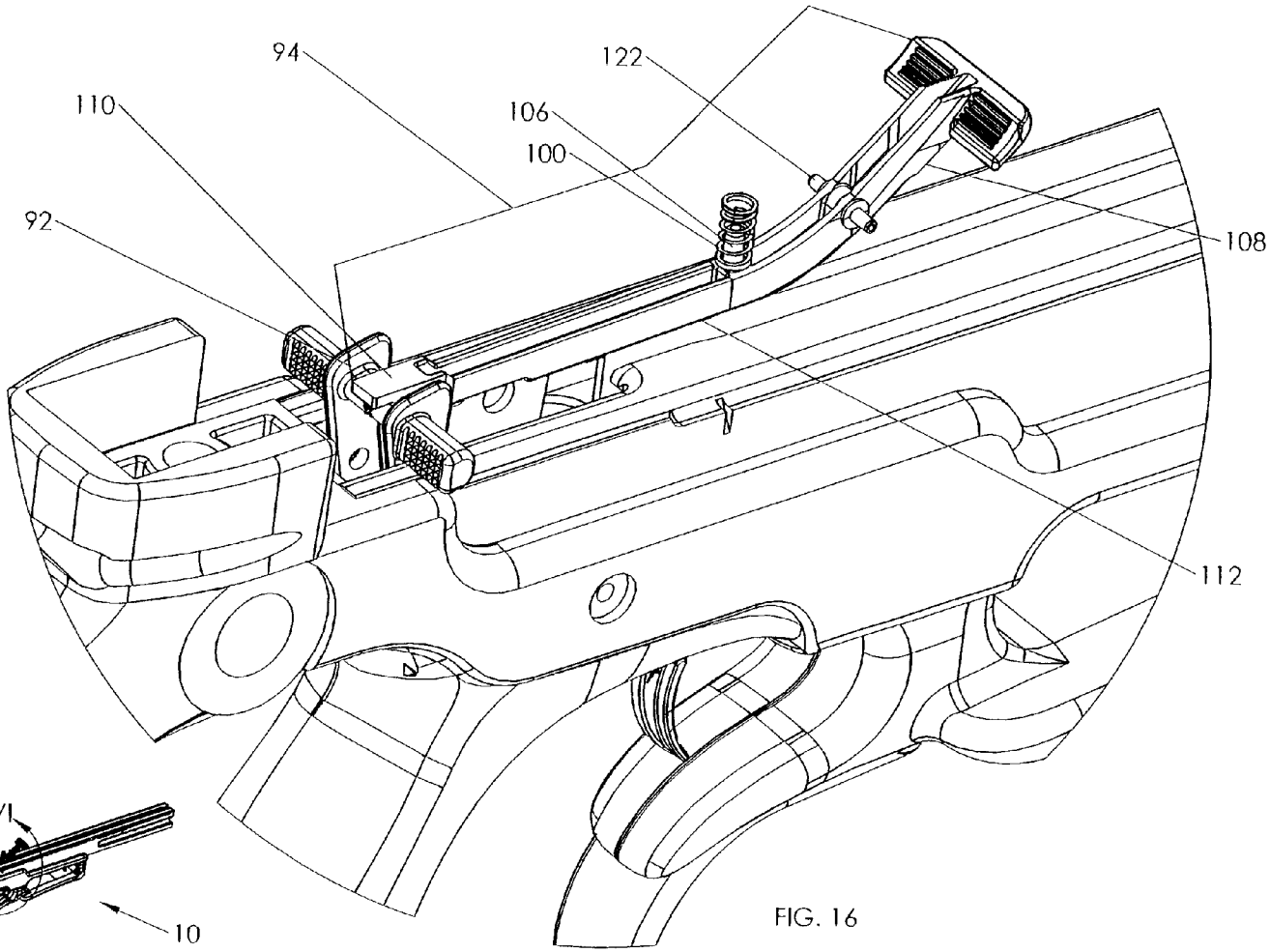
FIG. 16 is a partial, enlarged detail view thereof taken along XV-XV of FIG. 15.
Figure 15:
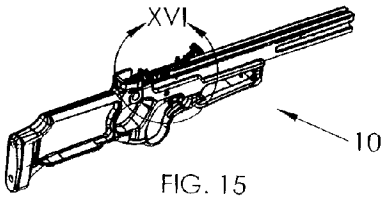
FIG. 15 is a side elevational view of an improved crossbow according to one embodiment of the present invention having loaded arrow safety actuator system.
Figures 17, 18:
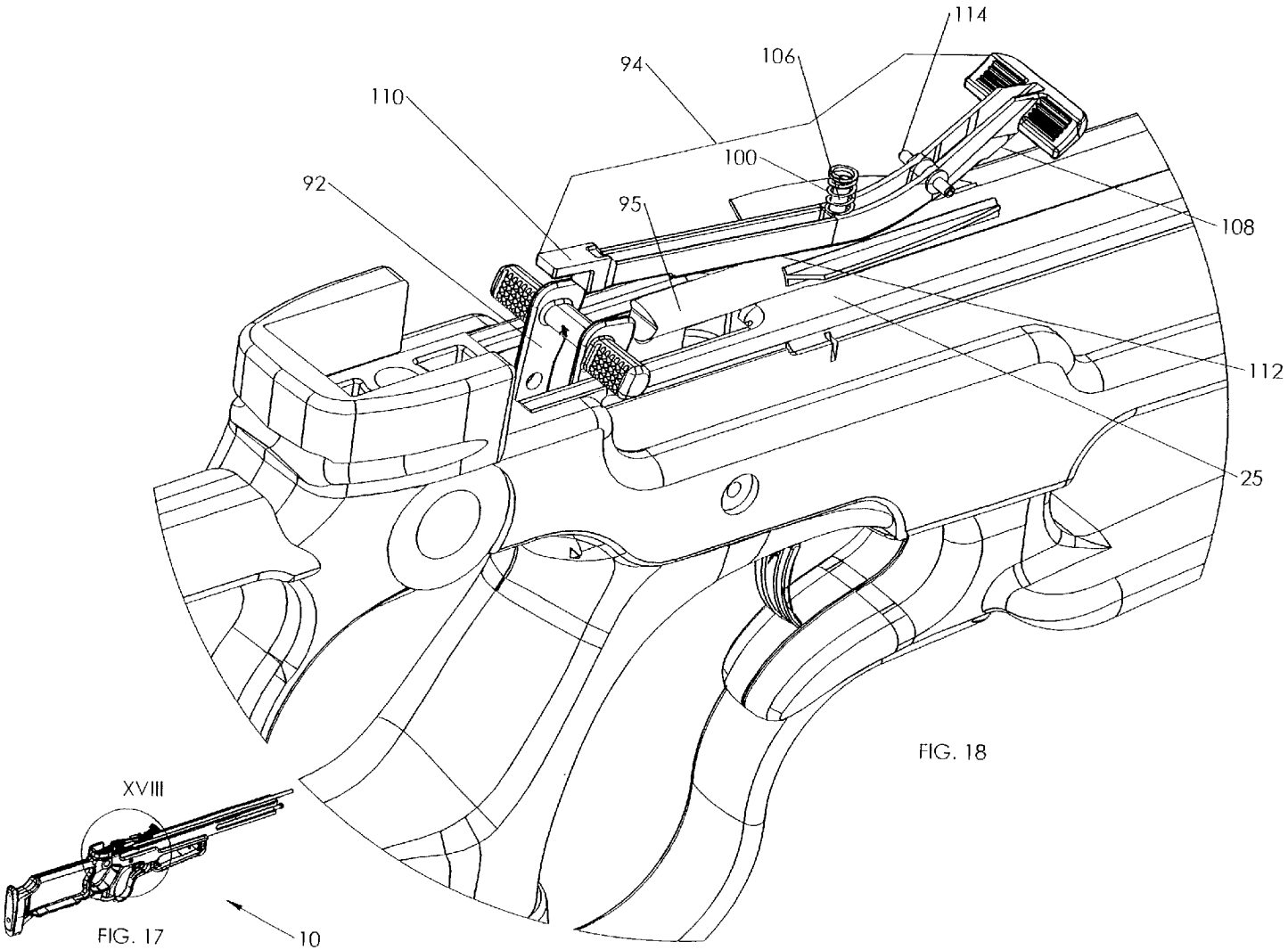
FIG. 17 is a side elevational view of an improved crossbow according to one embodiment of the present invention having a loaded arrow safety actuator system.
FIG. 18 is a partial, enlarged detail view thereof taken along XVII-XVII of FIG. 17.
Figure 19:
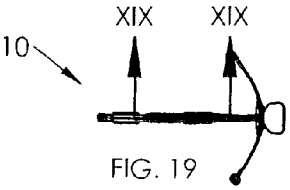
FIG. 19 is a top elevational view of an improved crossbow according to one embodiment of the present invention having a loaded arrow safety actuator system with the trigger safety in a 'safe' position.
Figure 20:
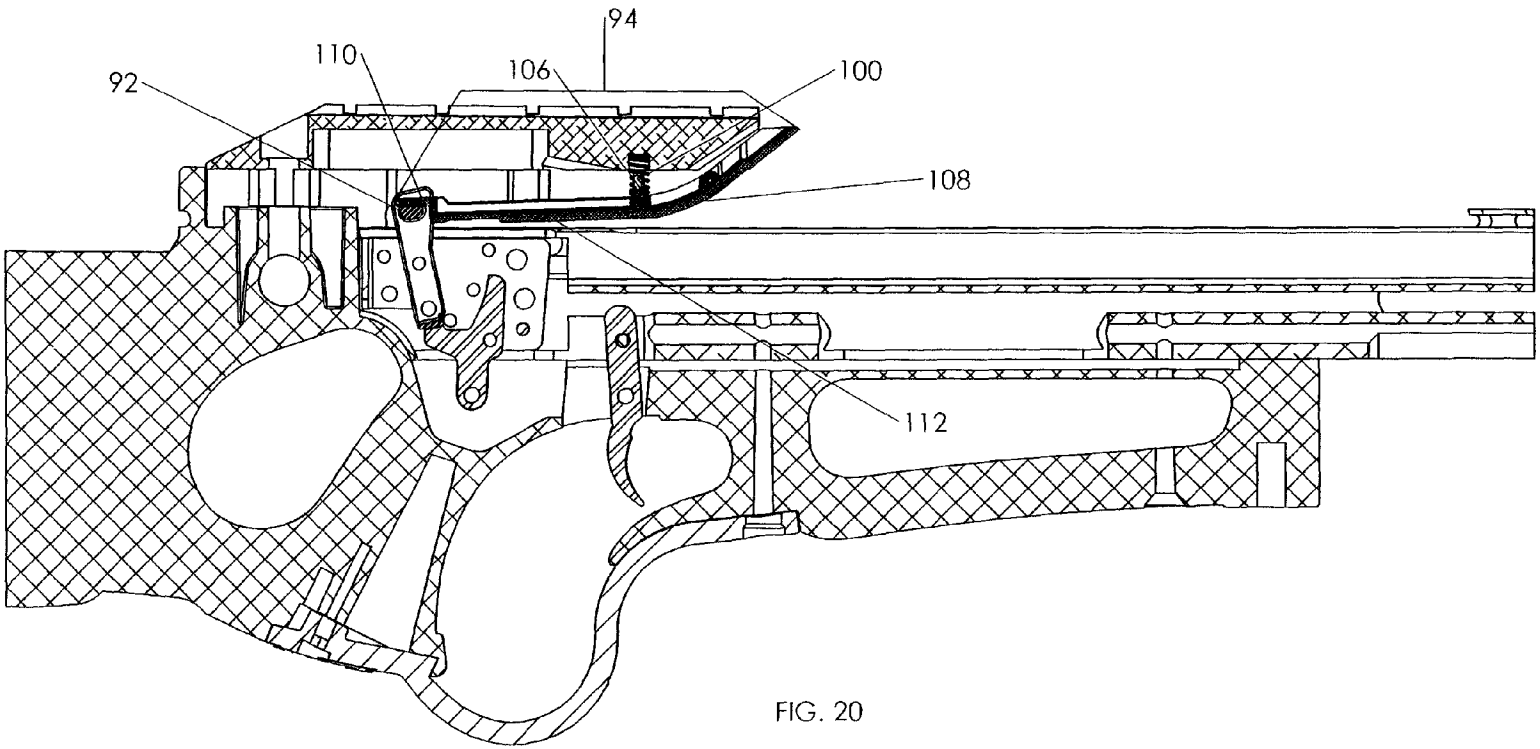
FIG. 20 is a partial, enlarged detail view thereof taken along XVIIII-XVIIII of FIG. 19.
Figure 21:
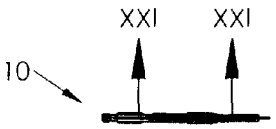
FIG. 21 is a is a top elevational view of an improved crossbow according to one embodiment of the present invention having a loaded arrow safety actuator system with the trigger safety in a 'fire' position.
Figure 22:
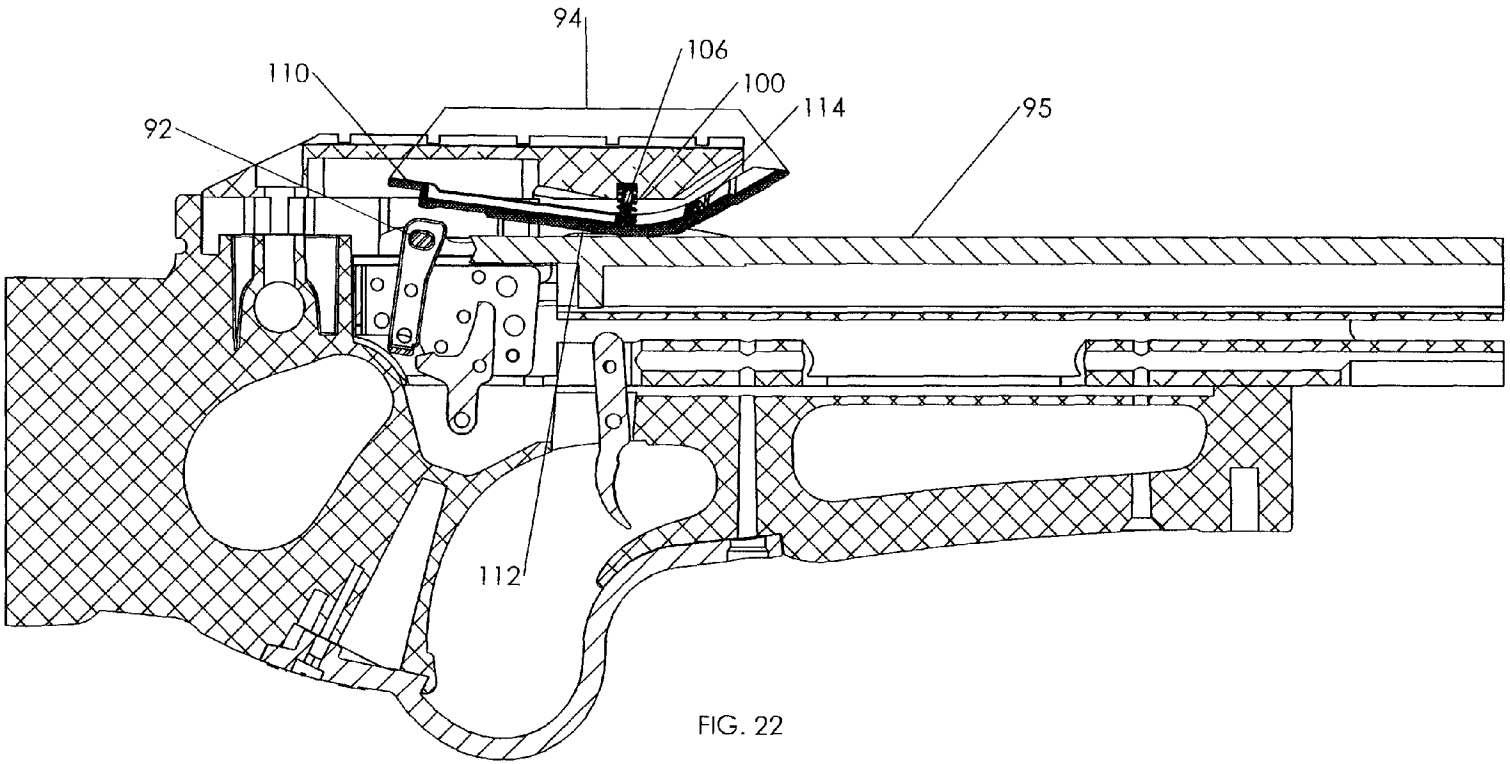
FIG. 22 is a partial, enlarged detail view thereof taken along XXI-XXI of FIG. 21.
Figure 23:
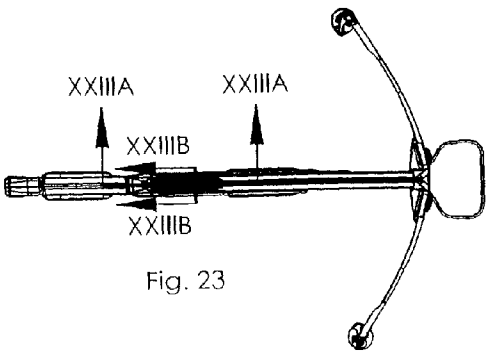
FIG. 23 is a is a top elevational view of an improved crossbow according to one embodiment of the present invention.
Figure 23A:
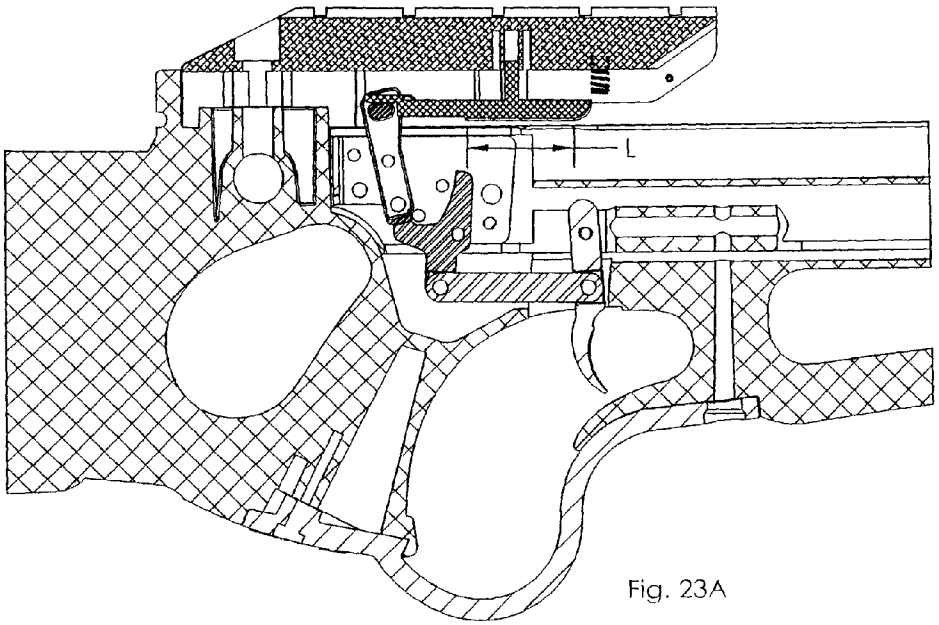
FIG. 23A is a partial, enlarged detail view thereof taken along XXIIIA-XXIIIA of FIG. 23.
Figure 23C:
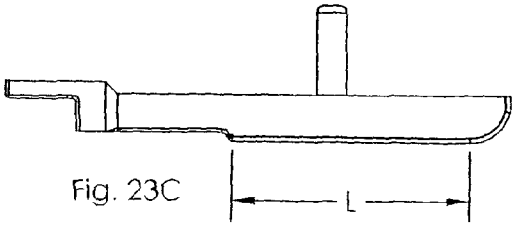
FIG. 23C is a perspective view showing the length L of the horizontally elongated arrow contacting surface according to one embodiment of the present invention.
Figure 23E:
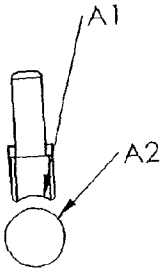
FIG. 23E is a perspective view showing the width W of the horizontally elongated arrow contacting surface according to one embodiment of the present invention.
Figure 23B:
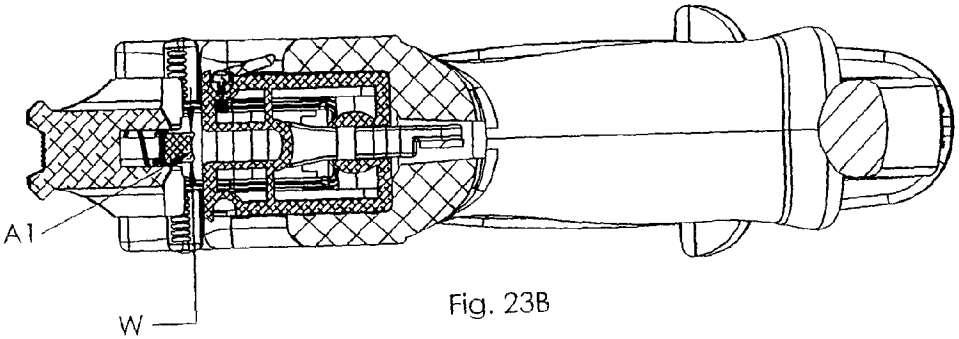
FIG. 23B is a partial, enlarged detail view thereof taken along XXIIIB-XXIIIB of FIG. 23.
Figure 23D:
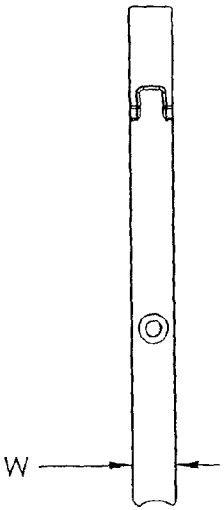
FIG. 23D is a perspective view showing the width W of the horizontally elongated arrow contacting surface according to one embodiment of the present invention.

As shown best in conjunction with FIG. 2 and FIG. 6, the shield 30 is always in a constant up position and held there by a mechanical means, such as, for example, a spring 35, which can urge the shield 30 upward, but which can still be overcome to push the shield 30 down out of the way so as not to interfere with the normal cocking function of the crossbow (as shown best in conjunction with FIGS. 4 and 8). Immediately upon completion of the cocking phase and when the hands or cocking aid are removed, the guard shield 35 will automatically be raised or urged into a deployed protective position without any user aid or assistance. Other mechanical means, such as a motor, may also be equivalently used to urge the shield 30 upward. In any equivalent, the spring or motor may be positioned in such a manner it is hidden or covered from the elements or conditions associated with typical hunting environments.

As depicted best in conjunction with FIG. 2 and FIG. 4, the guard mechanism 15 may utilize a shield 30 of any shape and of a width that offers reasonable depth to cover or protect the fingers from entering the string path. It is preferred that such a shield 30 length be at a minimum of the known power stroke of the crossbow or from the position where the string lies at rest to where it is when it's cocked waiting to be fired. Ideally the length is longer to facilitate the fact that when you grab the sting with your fingers or a cocking aid they push the shields down out of the way to a position that has minimally increased the barrel or stock width.

Referring to FIGS. 9-22, an improved crossbow, generally noted as 10, is provided having a loaded arrow safety actuator system, generally noted as 90, and is integrated internally within a crossbow 10 so as to be unexposed to the elements associated with normal outside weather hunting conditions. The loaded arrow safety actuator system 90 incorporates a trigger safety 92 and an arrow retention device 94 for retaining an arrow 95 within a crossbow 10 and alerting a user (not shown) that the arrow is loaded within the track 25 of a crossbow 10 by allowing the trigger safety 92 to move from a 'safe' position 96 to a 'fire' position 98. The system 90 further incorporates a plunger spring 100 for urging the arrow retention device 94 from a retracted position 102 to a deployed position 104.

In another embodiment according to the present invention, the arrow retention device 94 further incorporates a plunger 106 for contacting the arrow, an arcuate portion 108 for operatively connecting the arrow retention device 94 to the crossbow 10, and an end portion 110 for engaging the trigger safety 92. The plunger 106 can have a length L and a width W where the length L is at least a slightly longer distance than a distance of said width W. Since the length L of the plunger 106 is greater than the width W of the plunger 106, a greater contact surface area between the plunger 106 and arrow 95 is provided than if the length and width of the plunger 106 were the same distance. Further, the area of the plunger 106 that contacts the arrow 95 can be various shapes including circular, rectangular, cylindrical, chamfered or any shape that maximizes the contact surface area between the plunger 106 and the arrow 95. Although in this embodiment a plunger spring 100 and plunger 106 is used, it is anticipated that other devices such as a ball bearing plunger or steel spring retention member may be utilized for the same purposes.

In yet another embodiment according to the present invention, the arrow retention device 94 further incorporates a horizontally elongated arrow contacting surface 112 for contacting and retaining the arrow 95. The horizontally elongated arrow contacting surface 112 can have an arc A1 that is shaped to match an arc A2 of the loaded arrow 95 to increase contact surface area in the lateral plane of the arrow as well as to increase the contact surface area along a length of the arrow contacting surface 112. It is also envisioned that the horizontally elongated arrow contacting surface 112 is made of a material that will wear and conform to the shape of an arrow 95 as the crossbow 10 is continually loaded and fired. Although, in this embodiment, the point of contact between the horizontally elongated arrow contacting surface 112 and the arrow 95 are designed to wholly correspond to one another, the horizontally elongated arrow contacting surface 112 can also be designed so the point of contact with the arrow 95 only occurs at certain areas. For example, and not meant as a limitation, the horizontally elongated arrow contacting surface 112 can be configured to have a flat surface, with no arc, so that each portion of the horizontally elongated arrow contacting surface 112 only contacts a portion of the arrow 95 that is tangent to the arc A2 of the arrow 95. However, since the horizontally elongated arrow contact surface 112 has a length that is greater than its width, the overall contact area between the horizontally elongated arrow contacting surface 112 and the arrow 95 is beneficial.

In yet another embodiment according to the present invention, the arcuate portion 108 of the arrow retention device 94 incorporates a pivot 114 for pivoting the arrow retention device 94 from a retracted position 102 to a deployed position 104. Although in this embodiment the pivot 122 is disposed on the arcuate portion 108 of the arrow retention device 94, it is anticipated that the pivot 114 can be located anywhere on the loaded arrow actuator safety system 90 using sound engineering judgment. As compared to either conventional spring steel retention members or conventional plunger retention mechanisms, a minimum of at least twice the amount of surface area of the arrow 95 can be contacted by the arrow retention device 94 as compared to conventional arrow retaining members to prevent slipping or unintended discharge of the arrow 95 from the arrow retention device 94.

2. Operation of the Preferred Embodiment

In operation, the features and benefits of the present invention may be incorporated into the manufactured structure of a crossbow grip and barrel, or may alternately be adapted to add the operational features and benefits through attachment to elements of a separate crossbow. However, in any embodiment, the guard may be positioned below but relatively close to the string to allow the hand to be positioned under and closer to the guard while offering protection to the thumb/finger yet allowing for a higher grip or position of the support hand. In any embodiment, the guard is urged or positioned to be returnable to a constant up position and held there by a mechanical means, but yet which can be pushed down out of the way so as not to interfere with the normal cocking function of the crossbow.

While it should be understood that the guard or shield can be located on either side of the center of the stock to protect either left or right handed shooters to ensure that the fingers are protected, it is also anticipated that the guard or shield can be located on both sides of the center of the stock to protect both left and right handed shooters to ensure the protection of the thumb as well as the fingers. Typical use of the crossbow would have the support hand holding the stock with the users thumb located on one side of the stock while the fingers would be gripping the other side. In such an embodiment the guard or shields may work independent of each other.

While the guard system 15 is integrated into the barrel or stock 20, it is further anticipated that the shields 30 incorporated into the stock may be formed of wood, plastic, aluminum or other common material in a manner such as to be incorporated into the barrel or track of the crossbow or to allow a difference between the two components.

Additionally, a travel stop 40 may be incorporated into either the shield/guard or, as shown herein, the stock/barrel, and may be either in a fixed or adjustable position in such a manner as to limit the travel or position of the shield 30 when it is up or deployed to keep it from contacting the string and/or interfering with the strings forward and rearward motions. This is especially important if the shield 30 were to be designed shorter than the power stroke of the crossbow where it could then rise above the string and be damaged during firing or interfere with the cocking processes. It is anticipated that such a travel stop feature may be incorporated into the components or act as a separate piece or hard stop.

Further still, the guard may be positioned, or the shield may be designed or of a shape that stops on or minimally rests against the lower portion of the string to ensure its upper most position runs the entire length of the power stroke so as not to snag or grab the string.

The guard or shields are located on either side of the center of the string to protect both left and right handed shooters as well as ensure that the thumb is also protected as well as the fingers. Typical use of the crossbow would have the support hand holding the stock with the users thumb located on one side of the stock while the fingers would be gripping the other side. As such, the guard or shields should be capable of rotatably operating independent of each other.

Further, in operation, the loaded arrow safety actuator system 90 alerts a user that an arrow 95 is loaded within the track 25 of the crossbow 10. In one embodiment according to the present invention, the crossbow 10 is designed so that the trigger safety 92 is locked in a 'safe' position 96 and can only be manipulated into a 'fire' position 98 if an arrow is loaded or if the arrow retention device 94 of the present invention is manually overridden by the user to allow the trigger safety 92 to be manipulated. Further, because the trigger safety 92 is locked in a safe position 96 unless an arrow 95 is loaded or the arrow retention device 94 is manually overridden by the user the loaded arrow safety actuator system 90 also serves as a dry fire prevention device since the trigger mechanism cannot be utilized unless the trigger safety 92 lock is overridden. This is accomplished by providing a loaded arrow safety actuator system 90 having an arrow retention device 94 that automatically engages the trigger safety 92. When a user inserts an arrow 95 in the track 25 of the crossbow 10 to be loaded the arrow 95 comes into contact with the arrow retention device 94 and urges the retention device 94 in an upward direction overcoming the biasing of the plunger spring 100 and disengages the arrow retention device 94 from the trigger safety 92 allowing the trigger safety 92 to move from the 'safe' 96 position to the 'fire' position 98. Once the arrow 95 is fired, the plunger spring 100 urges the arrow retention device 94 from the retracted position 102 to the deployed position 104.

In one embodiment according to the present invention, the arrow retention device 94 has a plunger 106 for contacting the arrow 95, an arcuate portion 108 for operatively connecting the arrow retention device 94 to the crossbow 10, and an end portion 110 for engaging the trigger safety 92. In this embodiment, a user loads an arrow 95 into the crossbow 10 and when the arrow 95 contacts the plunger 106 and the arrow 95 is loaded or cocked within the crossbow 10 the arrow retention device 94 is urged by the plunger 106 in an upward direction into the retracted position 102 and the end portion 110 disengages from the trigger safety 92 allowing the user to manipulate the trigger safety 92 from a 'safe' position 96 to a 'fire' position 98 and the arrow retention device 94 is urged downward by said plunger spring 100 into the deployed position 104 upon firing of the arrow 95.

In another embodiment according to the present invention, the loaded arrow safety actuator system 90 utilizes an arrow retention device 94 that includes a plunger 106 for urging the arrow retention device 94 from a deployed position 104 to a retracted position 102, an arcuate portion 108 for operatively connecting the arrow retention device 94 to the crossbow 10, a horizontally elongated arrow contacting surface 112 for contacting the arrow, and an end portion 110 for engaging the trigger safety 92. In this embodiment the user loads an arrow 95 into the track 25 of the crossbow 10 and the arrow 95 contacts the horizontally elongated arrow contacting surface 116 and when the arrow 95 is loaded or cocked within the crossbow 10 the arrow retention device 94 is urged by the horizontally elongated arrow contacting surface 112 in an upward direction into the retracted position 102 and the end portion 110 disengages from the trigger safety 92 allowing the user to manipulate the trigger safety 92 from a 'safe' position 96 to a 'fire' position 98 and the arrow retention device 94 is urged downward by the plunger spring 100 and the plunger 106 into the deployed position 104 upon firing of the arrow 95.

In yet another embodiment according to the present invention, the arcuate portion 108 includes a pivot 114 for pivoting the arrow retention device 94 from a retracted position 102 to a deployed position 104. In this embodiment, when the arrow 95 comes into contact with the plunger 106 or the horizontally elongated arrow contacting surface 110, the arrow retention device 94 is urged upwards in a pivoting motion which reduces noise and spring vibration when compared to arrow retainers of conventional crossbows.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

Having thus described the invention what is claimed as new and desired to be secured by Letters Patent is as follows:

1. A crossbow comprising:

a crossbow grip guard having a pivoting member that extends for a length in a direction that is substantially parallel to the longitudinal axis of a crossbow barrel or stock, and that attaches to and extends outwardly in a direction that is substantially perpendicular to a stock when deployed and extends downwardly in a direction that is substantially parallel to the stock when retracted; and a loaded arrow safety actuator system having an arrow retention device operatively connected to said crossbow for retaining an arrow within a track of said crossbow and alerting a user that said arrow is loaded within said track by disengaging from a trigger safety when said arrow is loaded by allowing said trigger safety to be manipulated from a 'safe' position to a 'fire' position.

2. An improved crossbow comprising:

a guard that is integrated into the barrel or stock on at least one side of the stock, said guard running parallel to the track or area that the arrow sits in for a length of at least where the string is at rest to where the string is held or secured in the ready or firing position;

said guard being pivotally affixed such as to rotate between a deployed position and a retracted position;

a mechanical deployment mechanism for urging said guard to said deployed position;

a loaded arrow safety actuator system having an arrow retention device that retains an arrow and disengages from a trigger safety upon loading of said arrow within a track of said crossbow; and wherein in said deployed position said guard extends outward from the stock in a direction for a length that is perpendicular to the stock or axis/plane of the track or barrel covering the fingers from easily moving up into the path of the string and said arrow retention device indicates that an arrow is loaded within said crossbow and said arrow retention device retains said arrow within said track of said crossbow.

3. An improved crossbow having a loaded arrow safety actuator system, said loaded arrow safety actuator system comprising:

a trigger safety for preventing said crossbow from firing;

an arrow retention device for retaining an arrow within a track of said crossbow and alerting a user that said arrow is loaded within said track of said crossbow by allowing said trigger safety to move from a 'safe' position to a 'fire' position;

a plunger spring for urging said arrow retention device from a retracted position to a deployed position; and a plunger for contacting said arrow, an arcuate portion for operatively connecting said arrow retention device to said crossbow, an end portion for engaging said trigger safety, and wherein when said arrow contacts said plunger and said arrow is cocked within said crossbow said arrow retention device is urged by said plunger in an upward direction into said retracted position and said end portion disengages from said trigger safety allowing said user to manipulate said trigger safety from a 'safe' position to a 'fire' position and said arrow retention device is urged downward by said plunger spring into said deployed position upon firing of said arrow;

wherein when said arrow contacts said arrow retention device and said arrow is cocked within said crossbow said trigger safety is capable of moving from a 'safe' position to a 'fire' position.

4. The improved crossbow of claim 3, wherein said plunger has a length L and a width W, said length L is at least a slightly longer distance than a distance of said width W for providing a greater surface contact area between said plunger and said arrow as compared to conventional crossbow arrow retainers.

5. An improved crossbow having a loaded arrow safety actuator system, said loaded arrow safety actuator system comprising:

a trigger safety for preventing said crossbow from firing;

an arrow retention device for retaining an arrow within a track of said crossbow and alerting a user that said arrow is loaded within said track of said crossbow by allowing said trigger safety to move from a 'safe' position to a 'fire' position;

a plunger spring for urging said arrow retention device from a retracted position to a deployed position; and a plunger for urging said arrow retention device from a deployed position to a retracted position, an arcuate portion for operatively connecting said arrow retention device to said crossbow, a horizontally elongated arrow contacting surface for contacting said arrow, an end portion for engaging said trigger safety, and wherein when said arrow contacts said arrow contacting surface and said arrow is cocked within said crossbow said arrow retention device is urged by said arrow contacting surface in an upward direction into said retracted position and said end portion disengages from said trigger safety allowing said user to manipulate said trigger safety from a 'safe' position to a 'fire' position and said arrow retention device is urged downward by said plunger spring and said plunger into said deployed position upon firing of said arrow;

wherein when said arrow contacts said arrow retention device and said arrow is cocked within said crossbow said trigger safety is capable of moving from a 'safe' position to a 'fire' position.

6. The improved crossbow of claim 5, wherein said arcuate portion further comprises a pivot for pivoting said arrow retention device from a retracted position to a deployed position, wherein said pivoting of said arrow retention device reduces noise and spring vibration upon firing of said crossbow as compared to conventional crossbows.

7. The improved crossbow of claim 5, wherein said horizontally elongated arrow contacting surface has an arc A1 that is shaped to match an arc A2 of said arrow to increase a contact surface area in a lateral plane of said arrow retention device as well as to increase a contact surface area along a length of said arrow contacting surface.

8. An improved crossbow having a loaded arrow safety actuator system, said loaded arrow safety actuator system comprising:

a trigger safety for preventing said crossbow from firing;

an arrow retention device for retaining an arrow within a track of said crossbow and alerting a user that said arrow is loaded within said track of said crossbow by allowing said trigger safety to move from a 'safe' position to a 'fire' position;

a plunger spring for urging said arrow retention device from a retracted position to a deployed position; and wherein said loaded arrow safety actuator system is integrated internally within said crossbow so as to be unexposed to the elements associated with normal outside weather hunting conditions and wherein when said arrow contacts said arrow retention device and said arrow is cocked within said crossbow said trigger safety is capable of moving from a 'safe' position to a 'fire' position.

* * * * *